US006182475B1

(12) United States Patent
Lee

(10) Patent No.: US 6,182,475 B1
(45) Date of Patent: Feb. 6, 2001

(54) KNITTING MACHINE YARN GUIDING DEVICE AND ITS METHOD OF MANUFACTURE

(75) Inventor: Kyung-Mok Lee, Taegu (KR)

(73) Assignee: Keumyong Machinery Co., Ltd (KR)

( * ) Notice: Under 35 U.S.C. 154(b), the term of this patent shall be extended for 0 days.

(21) Appl. No.: 09/431,264

(22) Filed: Nov. 1, 1999

(30) Foreign Application Priority Data

Nov. 13, 1998 (KR) ..... 98-49140

(51) Int. Cl.[7] ..... D04B 9/34; D04B 15/58

(52) U.S. Cl. ..... 66/136; 66/141; 66/111; 264/328.2

(58) Field of Search ..... 264/328.2; 66/136, 66/141, 111

(56) References Cited

U.S. PATENT DOCUMENTS

| | | | | |
|---|---|---|---|---|
| 436,996 | * | 9/1890 | Power | 66/136 |
| 1,578,710 | * | 3/1926 | Byrd | 66/111 |
| 2,796,752 | * | 6/1957 | Hauberg | 66/136 |
| 3,643,476 | * | 2/1972 | Overdyck et al. | 66/111 |
| 3,887,387 | * | 6/1975 | Sturhahn | 106/57 |
| 5,160,097 | * | 11/1992 | Josefsson et al. | 242/47.01 |
| 5,989,492 | * | 11/1999 | Larsson | 419/36 |

FOREIGN PATENT DOCUMENTS

| | | |
|---|---|---|
| WO 94/20660 | 9/1994 | (WO) . |
| WO 94/23105 | 10/1994 | (WO) . |

* cited by examiner

*Primary Examiner*—Andy Falik
(74) *Attorney, Agent, or Firm*—Dinesh Agarwal, P.C.

(57) ABSTRACT

A yarn guiding device for a knitting machine to guide a yarn unreeled from a creel located above the knitting machine before feeding the yarn to a knitting needle. The device includes a rectangular main body including a supporting member with a slot and connecting holes, and a yarn guiding member with a U-shaped recess for connection to the supporting member and yarn paths. A bracket joins the main body through a connecting member to allow the main body to pivot forward and is disposed in the knitting section of the knitting machine. The yarn guiding member is molded from 80 to 95 by volume of zirconium oxide and 5 to 20 by volume of yttrium oxide.

4 Claims, 5 Drawing Sheets

KNITTING MACHINE YARN GUIDING DEVICE AND ITS METHOD OF MANUFACTURE

FIELD OF THE INVENTION

The present invention relates to a yarn guiding device for knitting device and more particularly a yarn guiding device for guiding the yarn unreeled from the creel, which is located above the knitting machine, before feeding the yarn in a guided manner to a knitting needle.

BACKGROUND OF THE INVENTION

Generally, the yarn guiding member of a yarn guiding device for knitting machine, which member is a component coming directly into contact with the running yarn, is mainly composed of a high grade steel for the sake of a high tenacity and erosion resistance.

While the guiding member of a yarn guiding device, consisting of the steel, can be used for a long period without a problem in the case of handling cotton yarns, the member can cause a hairy feathering on the knitting yarn or a breakage of the yarn owing to the wear of the area in contact with the passing yarn in the case of processing tough synthetic fiber yarns.

Thus, in recent years, a method was practised to improve the wear resistance of the yarn guiding device, wherein the inner wall of the yarn passage hole is coated with a hard film of metals or metal compounds such as chrome, titanium nitride or the like through plating process, but there was posed a problem in that the small dimension of the hole with its diameter of only about 1 mm and the shape of hole tapering toward the hole exit made an elaborate coating deep into the hole very difficult and moreover the duration life of the coating was short compared to the high preparation cost, requiring frequent replacements, whereby the efficiency of operation was extremely low.

To overcome the above-described problem, a yarn guiding member 4 of a yarn guiding device A' as shown in FIG. 7 was tried, which member was molded overall from an ordinary ceramic material excellent in wear resistance and hardness. However the product which experienced a distortion and deformation during the sintering process due to the spatial variation of shrinkage depending on the forming pressure was met with frequent breakage of the yarn guiding member, 4 when this member was firmly joined with a bracket 1 made of steel through a connecting hole 3 positioned in the upper part of the member. The sintered product was weak to impact and was also difficult to have a precise contour and smooth surface finishing to accelerate the wear of the knitting needle coming into contact with the yarn guiding member 4 up to the breakage of the needle, whereby the fed yarn is damaged to degrade the quality of the final knitgoods and sometimes even causes the stop of operation of the knitting machine.

SUMMARY OF THE INVENTION

The object of the present invention which was intended to resolve the above described drawbacks is to provide a yarn guiding device with a yarn guiding member which permits a smooth guide of knitting yarn under a constant tension without a hairy feathering and yarn breakage, which can contribute to the reduction in the price of yarn product through its simple and easy manufacturing and finishing process, and which can elevate the operating efficiency of a knitting machine through the improvement in its hardness, wear resistance and durability.

The object of the present invention is fulfilled through the improvement in the construction and material of the yarn guiding device according to the present invention which provides a yarn guiding device having a yarn guiding member, which member can be used for a long time due to a reduction in the wear from the contact with the knitting yarn, which does not only produce hairy feathers thanks to the excellent surface roughness in contact with the knitting yarn but also can prevent the wear of the knitting needle, and which is resistant to breakage and is able to maintain a high precision.

According to the invention, there is provided a yarn guiding device for a knitting machine, with a rectangular main body, which is formed on its upper part with a connecting hole for fixing a yarn guiding plate having yarn guiding holes and which is provided with yarn paths on its lower part, and with a bracket, which is joined to the main body through a connecting member so that the main body can be pivoted forward and which is disposed in the knitting section of a knitting machine, characterized in that the main body is broken down into two parts of a supporting member and a yarn guiding member, and the supporting member is formed on its lower part with a slot below which a connecting hole for the yarn guiding member is positioned, wherein the yarn guiding member is a molded article from 80 to 95 vol. % of zirconium oxide and 5 to 20 vol. % of yttrium oxide, and the yarn guiding member is formed with a recess in the form of U for connection with the supporting member through a slot and the connecting hole each formed on the supporting member and also formed with a number of yarn paths.

In addition, there is also provided according to the invention a process for manufacturing a yarn guiding member for a yarn guiding device as a molded article comprising the mixing process for raw materials, the pulverizing process wherein the mixed raw material is finely ground before pelletizing so as to be fitted for molding, the injection molding process wherein the mixed raw material is fused and withdrawn under pressure in a molding machine and then cooled, the thermal decomposition process wherein a porous article is formed by thermally decomposing the adhesive in the molded product, the sintering process wherein the burr or the like on the porous molded product is removed and subjected to crystallization at a high temperature and the finishing process wherein the molded product is polished and subjected to a gloss treatment to improve the surface smooth, characterized in that in the mixing process for raw materials, an inorganic mixture of zirconium oxide of 80 to 95 vol. % and yttrium oxide of 5 to 20 vol. % is mixed with the wax and organic adhesive at the blending ratio of 45:55 by volume at around 160° C. for 30 to 40 minutes, the injection molding is conducted under the pressure of 1000 to 1500 kg/cm$^2$ at the temperature of 160 to 170° C. for the retention time of 20 to 30 seconds or less to result in a molded density of 2.5 to 3.5 g/cm$^3$; the thermal decomposition process is conducted at 330 to 550° C. for 73 to 76 hours; and the sintering process is run for 15 to 20 hours as the temperature is raised up to 1500 to 1600° C. starting from 0° C.

Moreover, in one aspect of the present invention, the mixture of raw materials for molding the yarn guiding member of a yarn guiding device includes, beside the main components of zirconium oxide of 80 to 95 vol. % and yttrium oxide of 5 to 20 vol. %, a trace amount of aluminium oxide($Al_2O_3$), calcium carbonate($CaCO_3$), titanium oxide ($TiO_2$) and ferric oxide($Fe_2O_3$).

DETAILED DESCRIPTION OF THE INVENTION

A preferred embodiment of the invention will be described in detail below with reference to the attached drawings.

Figure 1:
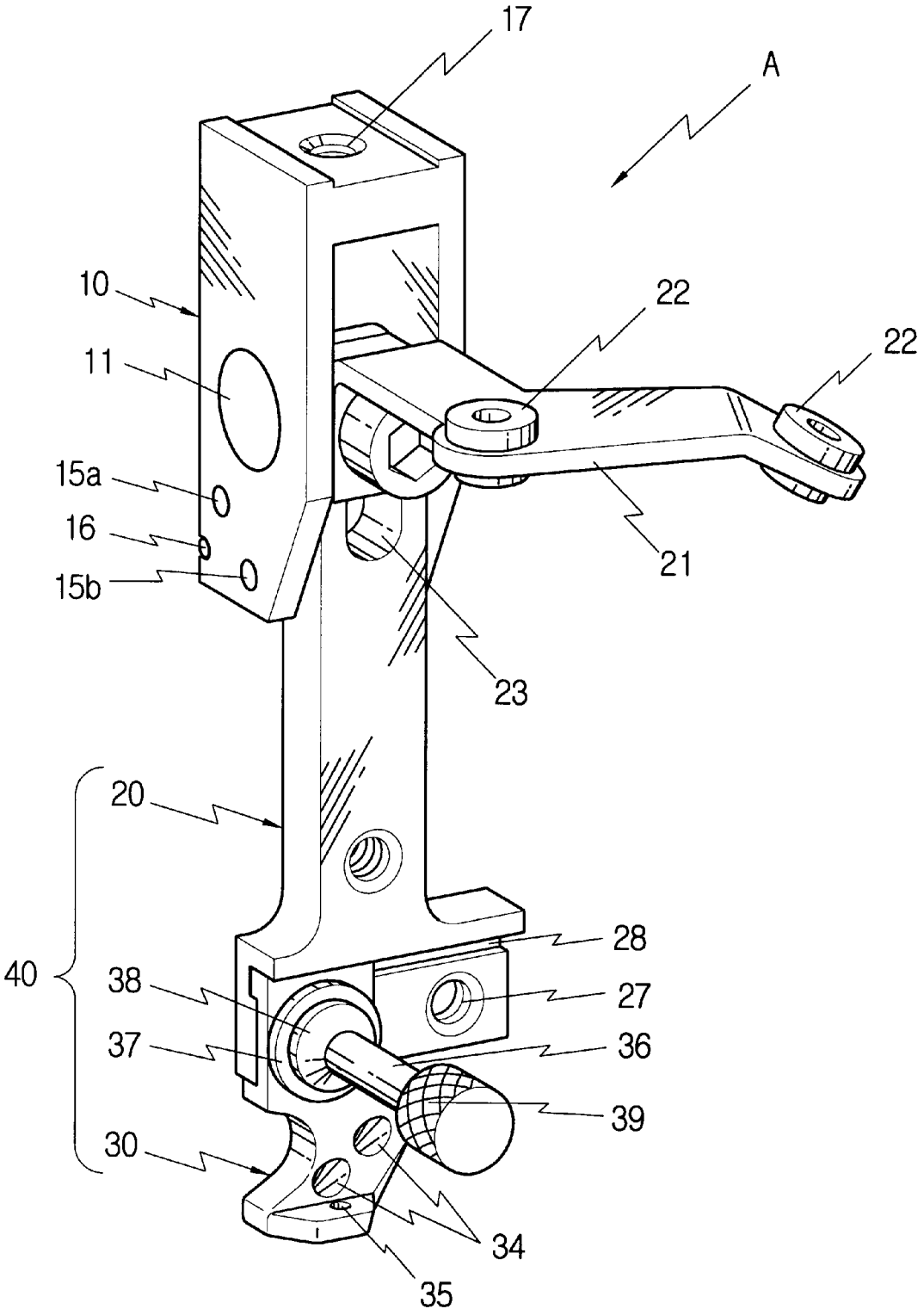
FIG. 1 shows the perspective view of a yarn guiding device for a knitting machine according to the invention.
Figure 2:
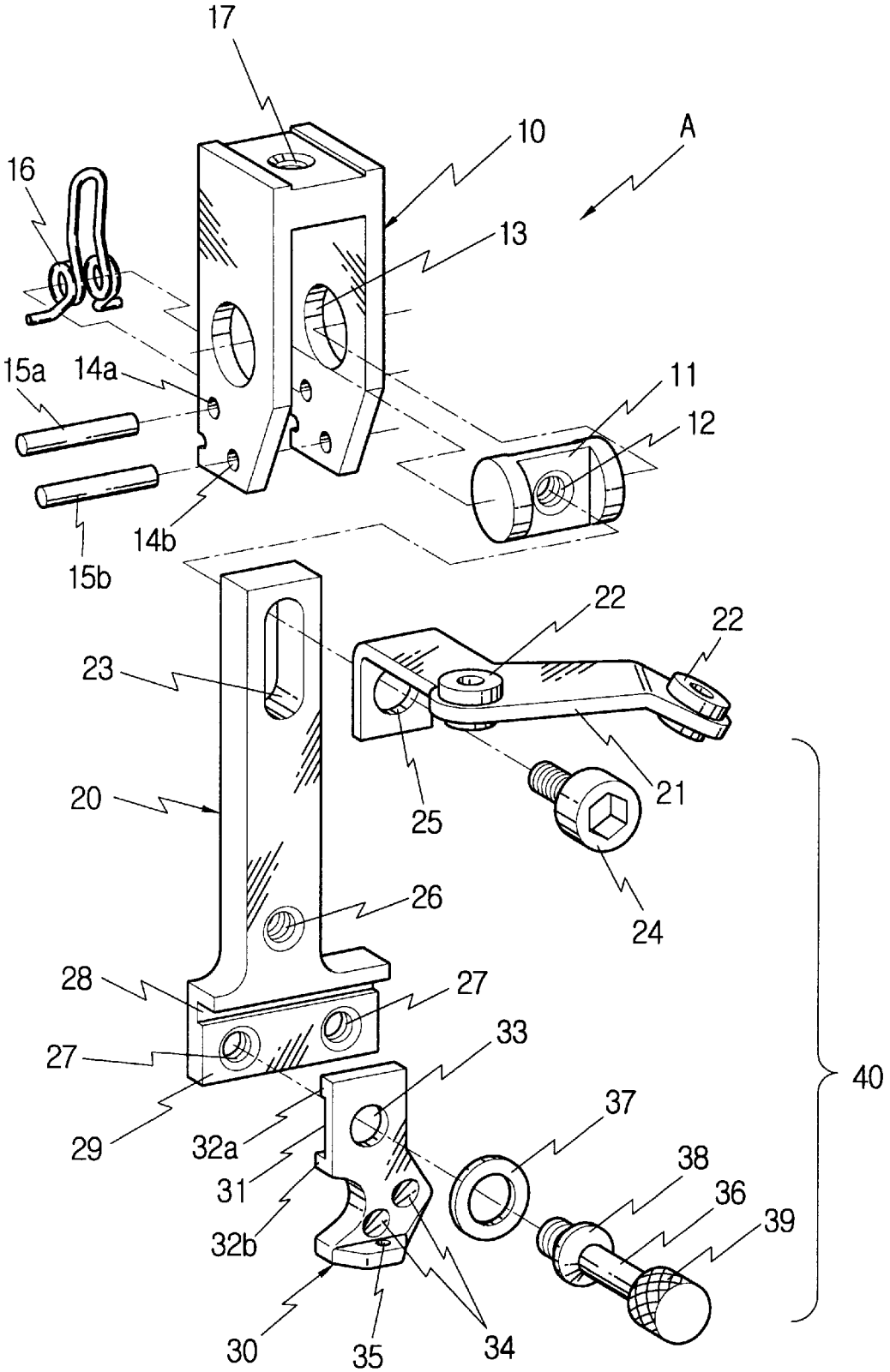
FIG. 2 shows the exploded view corresponding to FIG. 1.
Figure 3:
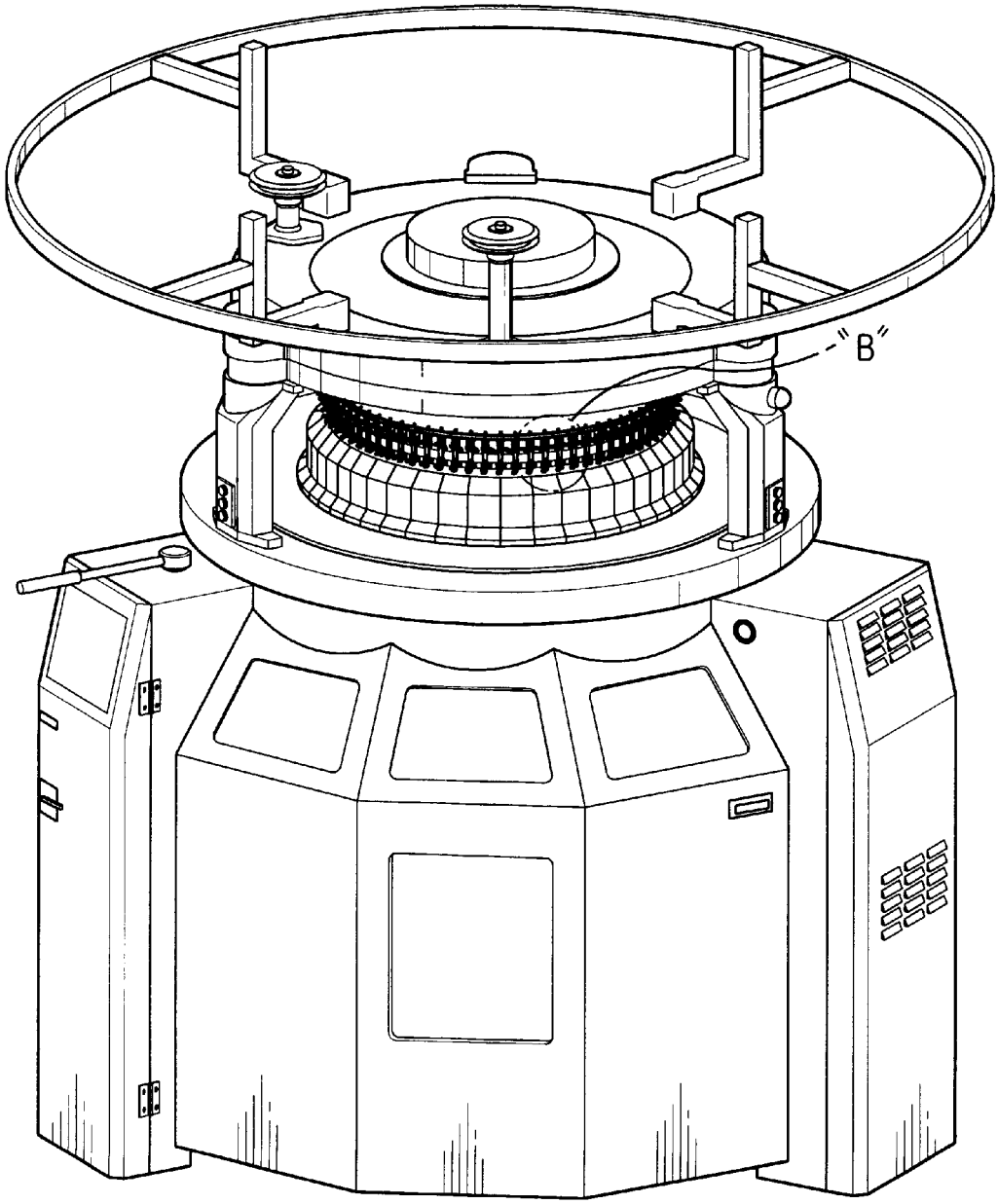
FIG. 3 shows as an embodiment a circular knitting machine in which a yarn guiding device for a knitting machine manufactured according to the invention is mounted.

Referring to FIGS. 1 and 2 which show a typical feature of a yarn guiding device for a knitting machine in an assembled state respectively in a perspective and exploded view and also to FIG. 3 which shows as an embodiment of application a state as installed in a circular knitting machine, a yarn guiding device A according to the invention essentially consists of a main body 40 in an approximately rectangular form, which body can be assembled from and disassembled into a supporting member 20 and a yarn guiding member 30 as well as a bracket 10 which is bound to an organization section of a knitting machine through a connecting hole 17.

The bracket 10 has substantially the form of U as shown in FIGS. 1 and 2 and is formed with openings on both sides to receive a cylindrical connecting member 11 which is cut out in the middle area. The bracket is also formed on its both side walls with holes 14*a* and 14*b* which are spaced at a definite distance and offset from each other, which are intended for insertion of position securing pins 15*a* and 15*b* and behind which an elastic spring 16 is held.

The supporting member 20 constituting a part of the main body 40 has an elliptical connecting hole 23 on its upper part to face on the corresponding connecting hole 25 on the yarn guiding plate 21 so that the yarn guiding plate 21 formed with yarn guiding holes 22 may be connected. The pre-assembly including the supporting member 20 and yarn guiding plate 21 is joined to the bracket 10 by means of appropriate fittings to permit the main body 40 to swing forward in the assembled state for possible future needs. The assembling operation will be further described in the following.

As can be seen in FIG. 2, the supporting member 20 may be further formed with a connecting hole 26 through which a required operating equipment can be attached depending on the material of knitting yarns such as a high elastic rubber yarn or the like. Particularly, the supporting member 29 is also formed on its bottom area 29 with a long slot having rectangular contour and a connecting holes 27, through which the yarn guiding member 30 as a ceramic formed product very unique to the present invention can be firmly attached. The above described connecting holes 27 are generally provided in the number of two or more so that the feeding angle for the yarn can be varied according to the structure of the knitted works finally manufactured.

Figure 5:
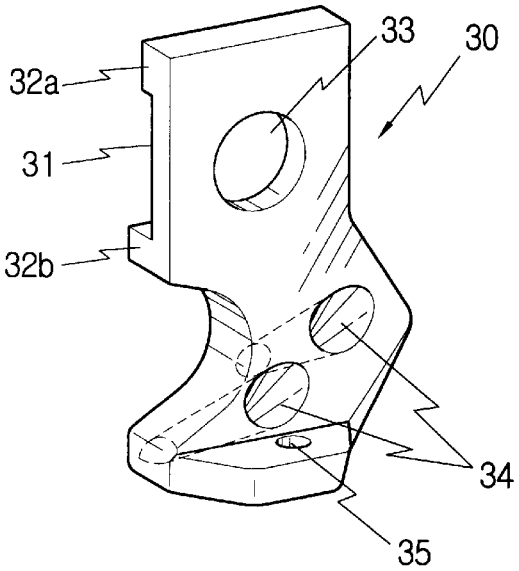
FIG. 5 shows the perspective view of a yarn guiding member representing an important part of a yarn guiding device according to the invention.

Of the two members constituting the main body 40, the yarn guiding member 30 to be connected to the bottom area of the supporting member 20 is, as shown in FIGS. 2 and 5, provided with a recess 31 having U-formed cross section and with a number of yarn through paths 34, 35 different in the diameter and position and located below the recess, with a connecting hole 33 disposed in the central area of the recess 31 for connection to the bottom area of the supporting member 20.

The opposite top and bottom projections 32*a* and 32*b* constituting the side walls of the recess 31 have the same height as the wall thickness of the member 30 and have each the vertical dimension equivalent to the width of the slot 28 on the supporting member 20. On one side of the member 30 or the left side in the drawing, there is formed a rounded concave below the bottom projection 32*b* to be suited for a smoother guide of the yarn, as seen better in FIG. 5.

The connection of the supporting member 20 and the yarn guiding member 30 is conducted by means of a connecting means 36 having a grip 39 and an annular collar 36 (see FIG. 2), wherein a washer 37 is preferably interposed.

As described before, in contrast to the supporting member 20 which is generally made of steel, the yarn guiding member 30 is composed of 80 to 95 vol. % of zirconium oxide and 5 to 20 vol. % of yttrium oxide as the main components through a molding process.

The yarn guiding device A according to the invention, which has substantially the constructions as described above, is assembled by first inserting the cylindrical connecting component 11 with a central groove in the holes 13 on the U-formed bracket 10, fitting the position securing pins 15*a* and 15*b* in the upper and lower holes 14*a* and 14*b*, wherein the position securing pin 15*a* is wound round by the spring 16.

Then, the supporting member 20 of the main body 40 is fitted on the groove of the connecting component 11 already mounted on the bracket 10, with the elliptical opening 23 on the supporting part 20 of the main body 40 aligned with the connecting hole 12 on the connecting component 11. Subsequently, the yarn guiding plate 21 is placed on the supporting member 20, with the hole 25 on the plate aligned with the elliptical opening 23 of the supporting member 20 as well as the opening on the component 11, whereby the connecting component 11, the supporting member 20 and the yarn guiding plate 21 are all connected firmly to the bracket 10 by threaded insertion of a connecting means 24 through the aligned holes.

Figure 6:
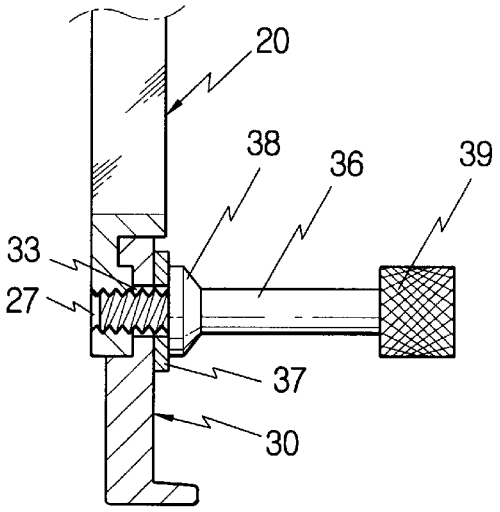
FIG. 6 shows the partial cross section of the yarn guiding member of FIG. 5 in a mounted state and FIG. 7 shows a conventional yarn guiding device.
Figure 7:
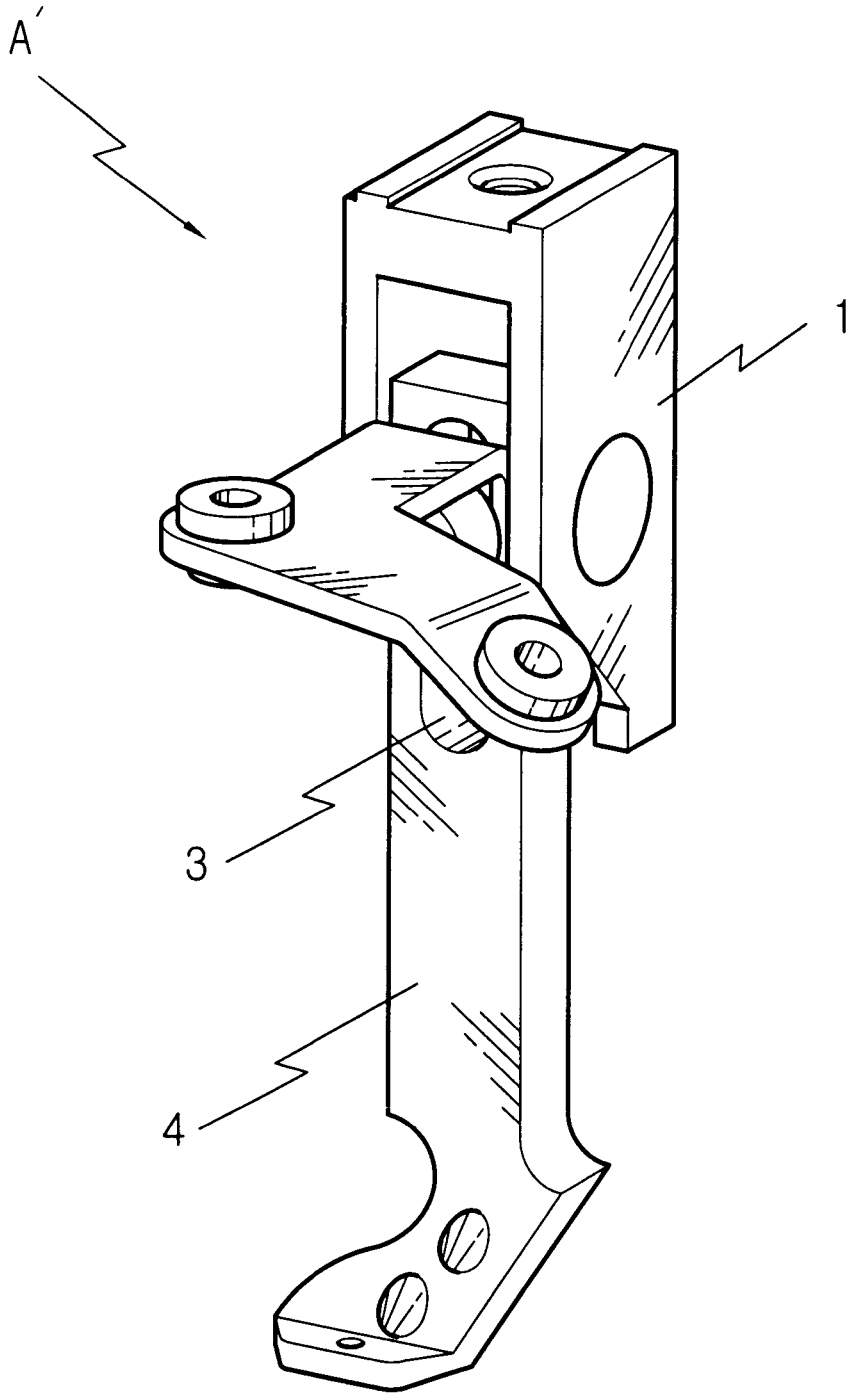
FIG.7 (PRIOR ART)

Next, the yarn guiding member 30 is firmly joined to the supporting member 20 by inserting the projection 32*a* in the mating slot 28 on the supporting member so that concurrently the recess 31 of the member 30 is engaged with the raised portion 29 on the supporting member 20, as better seen in FIG. 6 and then screwing the connecting means 36 together with the washer 37 through the hole 33 in the yarn connecting member 30 and the hole 27 on the supporting member 20.

Consequently, because the yarn guiding device A for a knitting machine according to the invention is so arranged that the supporting member 20 of the main body 40 can be swung forward around the cylindrical connecting component 11, in the case of a yarn breakage or interrupted feeding of the yarn, the main body 40 can be availed in the front so that a care can be taken for the resumed normal operation of the yarn through the yarn guiding holes 22 and the yarn through paths 34 and 35, wherein the released main body 40 can be returned, after the yarn feeding operation, to its original rear position in an elastic manner due to the elastic component 16 and can be prevented from over backward swing owing to the position securing pin 15*b* mounted on the bracket 10.

Figure 4:
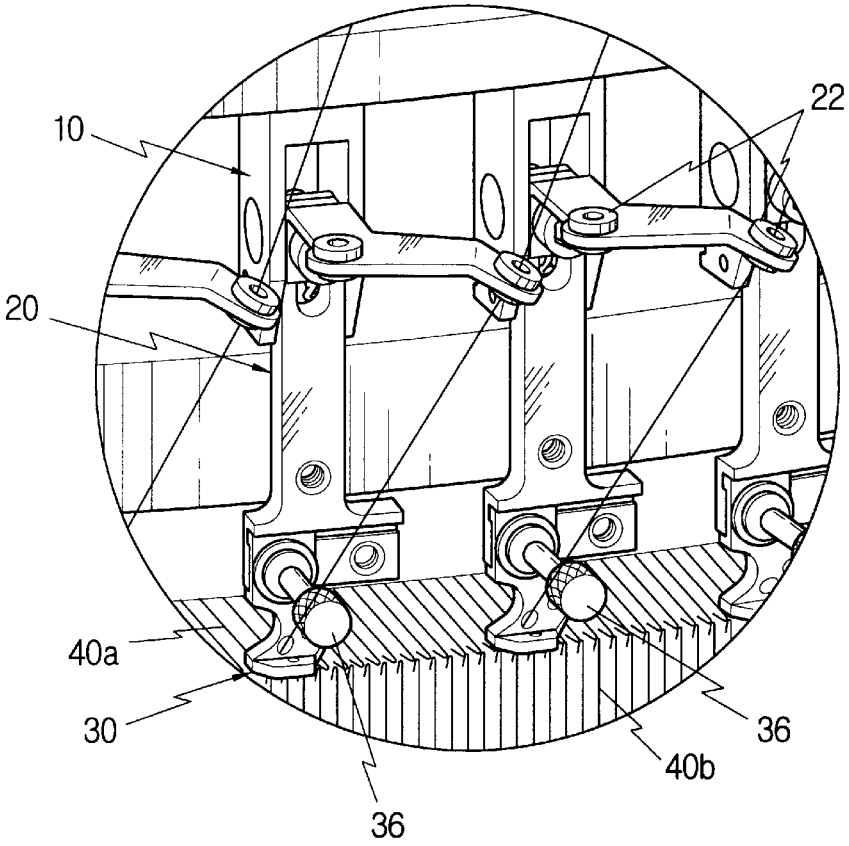
FIG. 4 shows the enlarged perspective view for the portion "B" in FIG. 1.

The yarn guiding device A for a knitting machine according to the invention, which is assembled or constructed as described above, is located, in a multiple number, in proximity to knitting needles of a knitting section, as shown in FIG. 3, particularly at "B" and in FIG. 4. In particular, the yarn guiding device A is so positioned that the lower part of the yarn guiding member 30 is positioned close to dial needles 41*a* and cylinder needles 41*b* of the knitting machine.

The yarn guiding device A for a knitting machine according to the invention which has a yarn guiding device 30 made of material with a high hardness is resistant to breakage and is so resistant to wear as to withstand the passage of a tough yarn like a synthetic fiber and further inflicts no damage such as a penetration, abrasion or the like on the knitting needles 41*a* and 41*b* coming in touch with it, as would be seen with the conventional machine, to permit a smooth knitting operation.

The yarn guiding member 30 which constitutes the principal feature of the yarn guiding device A for a knitting machine according to the invention is produced through a process of blending an inorganic mixture of essentially zirconium oxide of 80 to 95 vol. % and yttrium oxide of 5 to 20 vol. % together with the wax and organic binder at the mixing ratio of 45:55 by volume, wherein to assist in realizing a densely porous sintered product in some cases, a minimum amount of one or more inorganic sintering additives selected from aluminium oxide, calcium carbonate, titanium oxide and iron oxide are further added, under heating at about 160° C. for 30 to 40 minutes.

As the wax for use in the present invention, a vegetable wax including sumac wax from a lacquer tree, a sumac tree or the like and a petroleum-based wax including, for example, paraffin wax or petrolatum may be mentioned. As the organic adhesive for use in the present invention, there may be mentioned thermosetting synthetic resins such as phenol resin, urea resin, melamine resins, polyester resins, polyurethane resins, epoxy resins and silicone resins; thermoplastic resins such as polyvinyl acetate resins, polyvinyl alcohol resins, polyvinyl chloride resins and polyacrylate resins; and elastomers such as neoprene, butadiene and acrylonitrile rubber, wherein polyacryl resins are most preferable in view of the production of poreless dense injection moldings.

The ceramic mixture so prepared as described above for a yarn guiding member is then finely ground and pelletized for easy molding and subjected to injection molding under a pressure of 1000 to 1500 kg/cm$^2$ at a temperature of 160 to 170° C. for a retention time of 20 to 30 seconds to a molding density of 2.5 to 3.5 g/cm$^3$ before cooling to thereby provide a molded product with a desired structure.

Thereafter, the molded product is subjected to a heat treatment at a temperature of 330 to 550° C. for 73 to 76 hours in which the organic adhesive is removed via thermal decomposition to give a porous product and the undesired matter including bur is also removed and then the product so treated undergoes a sintering process in which the temperature is raised to 1500 to 1600° C. starting from 0° C. over a period of 15 to 20 hours. The sintered article is finally transferred to a surface treatment section where the surface of the product is ground and polished to provide a yarn guiding member with the improved surface roughness.

Through the particular preparation of raw material and the particular condition for injection molding, the yarn guiding member of a yarn guiding device for a knitting machine is manufactured as a high precision part due to the dimensional stability contrary to the conventional ceramic product which suffered from a severe shrinkage imbalance during the sintering process. The finished product can also have a very smooth surface mainly because of finely pulverized raw material, with the result that generation of hairlike filaments on the running yarn is avoided.

The following example serves to illustrate a process for manufacturing the yarn guiding member of a yarn guiding device for a knitting machine. However, the present invention is not intended to be restricted to this example or the embodiment as shown in the drawings and the corresponding description mentioned earlier and it should be evident to a man skilled in the art that many modifications and variations would be possible without departing from the spirit of the invention and within the claims appended.

EXAMPLE 85 vol. % of zirconium oxide and 13 vol. % of yttrium oxide are mixed first and to that mixture 1.5 vol. % of aluminium oxide plus 0.5 vol. % of calcium carbonate are further added to provide the master inorganic mixture.

Separately, an equal quantity of paraffin wax and polyacrylate resin are mixed under addition of solvent to provide the adhesive solution.

The inorganic mixture and the adhesive solution are mixed at the mixing ratio of 45:55 by volume, then the temperature are raised from room temperature to 160° C. and subsequently at the raised temperature the mixture is agitated or kneaded for 30 minutes.

The raw material mixture is finely milled by using a pulverizer and pelletized.

The pellets are introduced in the mold which is suited for producing a yarn guiding member having the above described structure to compose a yarn guiding device for a knitting machine according to the invention and the mixture is melted by raising the temperature to 160° C. The melted mixture is subjected to the injection molding step wherein the mixture is injected under the pressure of 1100 kg/cm$^2$ within the retention time of 20 seconds at the molding density of 2.8 g/cm$^3$ to provide the unsintered green product. After cooling, the green product is heat treated by raising the temperature to 200° C. over the first period of 21 hours and raising again the temperature to 450° C. over the second period of 42.5 hours, whereby the porous yarn guiding member through thermal decomposition of the adhesive remaining in the molded product is provided.

After removal of the burry matter on the molded product, the product is sintered by raising the temperature to 600° C. over the first period of 7 hours and raising further the temperature to 1500° C. over the second period of 11 hours. The sintered molded product of the yarn guiding member showed the predetermined shrinkage as expected.

The molded product was polished on its surface, gloss treated and finishing processed for improved surface quality to provide the finalized yarn guiding member. The product showed a high hardness and wear resistance.

As the result of test in which the yarn guiding member 30 as produced and having the same structure as shown in FIG. 1 was connected to the supporting member 20 of a yarn guiding device A, the resulting assembly was mounted on a double interlock circular knitting machine and the machine was operated continuously for three months by using polyamide-based fiber yarn with 75 deniers, there were observed no flaws such as a yarn breakage, appreciable wear, warping or distortion of the part and damage on neighboring knitting needles leading to stoppage of the machine.

As is clear from the above description, the yarn guiding device for a knitting machine according to the invention has the excellent technical and economic advantage mainly due to the reasonable construction of the yarn guiding device on one hand and the yarn guiding member made through a particular process from a particular material on the other hand. The convenient construction permits e.g. an easy and comfortable tendance or service including re-feed of yarn or replacement of parts. The yarn guiding member made of special material has the advantage of e.g. damage prevention and trouble-free quality operation due to its high hardness and the advantage of prevention of e.g. yarn breaking and damaging on nearby knitting needles due to its extremely smooth surface.

What is claimed is:

1. A yarn guiding device for a knitting machine, comprising:

a rectangular main body formed on an upper part thereof with a connecting hole for fixing a yarn guiding plate having yarn guiding holes and provided with yam through paths on a lower part, thereof;

a bracket joined to the main body through a connecting member for allowing the main body to pivot forwards said bracket adapted to be disposed in the knitting section of a knitting machine;

the main body comprising a supporting member and a yam guiding member;

the supporting member comprising a slot and a connecting hole;

the yarn guiding member comprising a molded article made from 80 to 95 vol. % of zirconium oxide and 5 to 20 vol. % of yttrium oxide; and the yarn guiding member comprising a U-shaped recess for connection with the supporting member through the slot and the connecting hole.

2. The yarn guiding device according to claim 1, wherein said yarn guiding member is molded from a mixture of raw materials comprising zirconium oxide and yttrium oxide.

3. The yarn guiding device according to claim 2, wherein said mixture further comprises an inorganic compound selected from the group consisting of aluminum oxide, calcium carbonate, titanium oxide and iron oxide.

4. A process for manufacturing a yarn guiding device of claim 1, comprising the steps of:

a) providing an inorganic mixture comprising 80–95% by volume zirconium oxide and 5–20% by volume yttrium oxide;

b) providing a suitable wax and an organic adhesive;

c) mixing the materials of steps a) and b) at a blending ratio of 45:55 by volume at a temperature of about 160° C. for about 30–40 minutes;

d) pulverizing the mixture obtained in step c) until finely ground followed by pelletizing;

e) forming a molded product by injection molding the pelletized mixture obtained in step d) at a pressure of 1000–1500 kg/cm$^2$, a temperature of 160–170° C., for a retention time of 20–30 seconds or less, and at a molded density of 2.5–3.5 g/cm$^3$, the injection molding step comprising fusing and withdrawing the pelletized mixture under pressure;

f) cooling the molded product obtained in step e) to a desired temperature;

g) forming a porous article by thermally decomposing the adhesive in the molded product at a temperature of 330–550° C. for about 73–76 hours;

h) sintering the porous article by raising the initial temperature from a range of about 0° C. to room temperature to a final temperature of about 1500–1600° C., wherein the sintering treatment is carried out for a period of about 15–20 hours; and i) finishing the sintered porous article by polishing.

* * * * *